US009518451B2

(12) United States Patent
Luppi

(10) Patent No.: US 9,518,451 B2
(45) Date of Patent: Dec. 13, 2016

(54) ASSEMBLY FOR CONNECTING UNDERWATER PIPES

(71) Applicant: TECHNIP FRANCE, Courbevoie (FR)

(72) Inventor: Ange Luppi, Nîmes (FR)

(73) Assignee: TECHNIP FRANCE (FR)

( * ) Notice: Subject to any disclaimer, the term of this patent is extended or adjusted under 35 U.S.C. 154(b) by 0 days.

(21) Appl. No.: 14/763,266

(22) PCT Filed: Jan. 24, 2014

(86) PCT No.: PCT/FR2014/050139

§ 371 (c)(1),
(2) Date: Jul. 24, 2015

(87) PCT Pub. No.: WO2014/114891

PCT Pub. Date: Jul. 31, 2014

(65) Prior Publication Data

US 2015/0361770 A1 Dec. 17, 2015

(30) Foreign Application Priority Data

Jan. 25, 2013 (FR) ..... 13 50662

(51) Int. Cl.
*E21B 43/01* (2006.01)
*E21B 19/16* (2006.01)
(Continued)

(52) U.S. Cl.
CPC ..... *E21B 43/0107* (2013.01); *E21B 17/01* (2013.01); *E21B 17/012* (2013.01); *E21B 17/015* (2013.01);
(Continued)

(58) Field of Classification Search
CPC ..... E21B 43/0107; E21B 17/01; E21B 17/20; E21B 19/16; E21B 19/002; E21B 17/015; E21B 17/012
See application file for complete search history.

(56) References Cited

U.S. PATENT DOCUMENTS 7,073,593 B2 * 7/2006 Hatton ..... E21B 7/128 166/345
8,267,179 B2 * 9/2012 Butcher ..... E21B 43/0107 166/341
2005/0070150 A1 * 3/2005 Williams ..... E21B 23/006 439/374

FOREIGN PATENT DOCUMENTS

FR 2 809 136 A1 11/2001
GB 2 453 168 4/2009
(Continued)

OTHER PUBLICATIONS

International Search Report dated Mar. 13, 2014 issued in corresponding International patent application No. PCT/FR2014/050139.
(Continued)

*Primary Examiner* — James G Sayre
(74) *Attorney, Agent, or Firm* — Ostrolenk Faber LLP

(57) ABSTRACT

An underwater connection assembly, and a connection method, for connecting a riser (12) and a flexible pipe (26). The riser (12) has an upper connection end (52) and the flexible pipe (26) has a lower connection end (30). The connection assembly includes a longitudinal frame (36) having a foot (46) rigidly connected to the upper connection end (52) and a head (42) linked to a float (20). A connector (34), and a curved pipe (32) having two opposing ends (62, 64). The opposing end (62) is rigidly connected to the lower connection end (30), and the connector (34) is mounted to the other opposing end (64), to be able to pull the connector (34) towards the upper connection end (52) in a direction oriented from the head (42) to the foot (46).

11 Claims, 6 Drawing Sheets

(51) Int. Cl.
*E21B 19/00* (2006.01)
*E21B 17/01* (2006.01)
*E21B 17/20* (2006.01)

(52) U.S. Cl.
CPC ..... *E21B 17/20* (2013.01); *E21B 19/002* (2013.01); *E21B 19/16* (2013.01)

(56) References Cited

FOREIGN PATENT DOCUMENTS

| | | | | | |
|---|---|---|---|---|---|
| GB | 2453168 | A * | 4/2009 | ..... | E21B 17/012 |
| GB | 2 468 653 | | 9/2010 | | |
| GB | 2468653 | A * | 9/2010 | ..... | E21B 17/085 |
| GB | 2 472 644 | | 2/2011 | | |
| WO | WO 2009/112687 | | 9/2009 | | |
| WO | WO 2012/076520 | A2 | 6/2012 | | |

OTHER PUBLICATIONS

Written Opinion dated Mar. 13, 2014 issued in corresponding International patent application No. PCT/FR2014/050139.

* cited by examiner

ASSEMBLY FOR CONNECTING UNDERWATER PIPES

CROSS-REFERENCE TO RELATED APPLICATIONS

The present application is a 35 U.S.C. §§371 national phase conversion of PCT/FR2014/050139, filed Jan. 24, 2014, which claims priority of French Patent Application No. 1350662, filed Jan. 25, 2013, the contents of which are incorporated by reference herein. The PCT International Application was published in the French language.

TECHNICAL FIELD

The present invention relates to the field of underwater installations enabling hydrocarbons to be conveyed between a seabed and a surface.

One field of application is notably that of petroleum exploitation at great depths.

TECHNICAL BACKGROUND

Such well-known underwater installations include a riser pipe that extends from the seabed as far as an intermediate area overlying the seabed and situated below the surface and a flexible pipe connected to extend the riser pipe and the flexible pipe extends catenary fashion from the intermediate area to the surface where it is connected to a surface installation. The riser pipe is kept substantially vertical by means of a float submerged in the intermediate area. This type of installation makes it possible to raise hydrocarbons from the seabed to the surface without being constrained by disturbances of the surface linked to swell, currents or winds.

The document WO2009/112 687 describes an underwater installation of this type. The underwater installation usually includes a frame enabling the end of the riser pipe and the float to be connected together, and the frame is equipped with a curved swan-neck pipe that extends the riser pipe. The pipe has a free end provided with a connecting end fitting. In a first installation phase, the frame and the float are installed to hold the riser pipe in vertical equilibrium. In a second installation phase the flexible pipe terminated by a connector is connected to the end fitting, from the surface, so as to establish the connection between the riser pipe and the flexible pipe. To this end, the connector is specifically equipped with a retractable flange and is installed at the end of the flexible pipe. It approaches the frame as the flexible pipe is paid out from the surface. As for the frame, it includes retaining members and the retractable flange is then engaged in the retaining members. More of the flexible pipe is paid out and the connector then tilts around the retaining means so that it abuts against a bearing member and faces the end fitting on the pipe. The connector is then driven toward the end fitting by retracting the flange to connect them together.

Difficulties arise in connecting the connector to the end fitting at greater depths of water. In fact, the riser pipes are longer and consequently heavier. The same gees-fer applies to the flexible pipes, and the forces to be exerted on the connector are consequently higher. Now the latter connectors are fragile and costly. Moreover, during the phase of moving the connector and the frame closer to each other, and because of the masses involved, the slightest impacts can have an impact on the integrity of the connector, notably when the connector tilts and comes into contact with the bearing member.

Also, a problem that arises and that the present invention aims to solve is to provide an underwater connection assembly that makes it possible to preserve the integrity of the connector during connection.

SUMMARY OF THE INVENTION

To this end, and according to first subject matter, the present invention is an underwater connection assembly for connecting, between a seabed and a surface, a riser pipe extending from said seabed toward said surface and a flexible pipe extending to said surface the riser pipe has a connecting upper end and the flexible pipe having a connecting lower end; the connecting assembly comprising on the one hand a longitudinal frame including a foot fastened to the connecting upper end and a head configured to be connected to a float and on the other hand a connector and a curved pipe having two opposite ends so as to be able to connect said flexible pipe in catenary manner to said riser pipe. According to the invention, one of said opposite ends of said curved pipe is adapted to be fastened to said connecting lower end while said connector is mounted at the other of said opposite ends so as to be able to drive said connector toward said connecting upper end in a direction oriented from said head toward said foot, guiding said curved pipe through said frame.

Accordingly, one feature of the invention resides in the use of the curved pipe, fixed in position at the connecting lower end of the flexible pipe, and no longer at the end of the riser pipe, and placing the connector at the other end of the curved pipe. As a result, the curved pipe is suspended from a guide cable going to a laying ship and in a first phase the curved pipe from which the flexible pipe is itself suspended is moved toward the frame in a direction substantially perpendicular to the riser pipe. The curved pipe is then passed through the frame at the level of the head, while the connector extends coaxially facing the connecting upper end of the riser pipe. The cable is then substantially released and the curved pipe descends through the longitudinal frame while the connector is driven coaxially toward the connecting upper end of the riser pipe onto which it is finally engaged. Consequently, the routing of the connector, both in the phase of approaching the frame and in the connection phase as such, protects it from impacts and consequently from damage.

Moreover, and in accordance with one particularly advantageous feature of the invention, the frame comprises guide ramps extending in said direction oriented from said head toward said foot to guide said curved pipe. As a result, the curved pipe can come to bear against the guide ramps so that when the guide cable is released it is guided in translation by the guide ramps toward the foot of the frame while the connector is for its part guided toward the connecting upper end. Preferably, said other of said opposite ends of said curved pipe comprises diametrically opposite guide studs adapted to cooperate with said guide ramps. The opposite guide studs therefore come to bear against the guide ramps and they are driven to rub against the latter when the guide cable is released.

In accordance with one particularly advantageous embodiment of the invention, said guide ramps comprise two posterior uprights respectively adapted to receive said guide studs that bear on them. The two posterior uprights are mounted parallel to each other and parallel to the direction of the frame extending from the head toward the foot. Moreover, said guide ramps preferably further comprise two anterior uprights respectively facing said posterior uprights so as to be able to trap said guide studs. Each of the guide studs is therefore mounted to slide between an anterior upright and a posterior upright. As a result, the curved pipe is perfectly guided in translation through the longitudinal frame simply by releasing the guide cable.

Moreover, the guide studs include longitudinal bearing surfaces extending parallel to the axis of said connector. Said other of said opposite ends is therefore immobilized against pivoting and the connector and the connecting end of the riser pipe therefore remain coaxial as they approach each other.

Also, said frame further comprises a receiving carriage mounted to slide on said guide ramps to receive said other of said opposite ends of said curved pipe that bear on it. The guide studs are for example adapted to come to bear on the receiving carriage, notably when the connector is connected to the connecting upper end of the riser pipe. As a result, the frame can be equipped with a device for driving the receiving carriage from the foot toward the head so as to be able to disconnect the connector as described in more detail hereinafter.

Said two opposite ends of said curved pipe advantageously define two axial directions substantially inclined one relative to the other, for example at an angle between 10 and 20°. Said other of said opposite ends of the curved pipe therefore extends substantially vertically, in line with the riser pipe which is itself vertical, while said one of said opposite ends is inclined. The flexible pipe then comes to extend in catenary fashion from this inclined opposite end.

Additionally, said curved pipe advantageously comprises a connecting beam for connecting together said two opposite ends. As a result, the two opposite ends of the curved pipe are held perfectly in a fixed position relative to each other and the curved pipe is perfectly rigid. Said connecting beam preferably includes an arm extending cantilever fashion in line with said connecting beam opposite said other of said opposite ends relative to said one of said opposite ends. The arm then makes it possible to site the anchoring of the guide cable remotely relative to the axis of the connector and therefore to be able to maneuver the guide cable without reference to the float above the frame. In accordance with a variant embodiment, said arm includes a removable part. This removable part can then be removed after the connection is established between the flexible pipe and the riser pipe.

In accordance with other subject matter, the present invention proposes a method of underwater connection between a seabed and a surface of a riser pipe extending from said seabed toward said surface and a flexible pipe extending to said surface, said riser pipe including a connecting upper end and said flexible pipe including a connecting lower end, said connection method being of the type wherein there are procured on the one hand a longitudinal frame having a foot fastened to said connecting upper end and a head intended to be connected to a float and on the other hand a connector and a curved pipe having two opposite ends so as to be able to connect said flexible pipe in catenary manner to said riser pipe. According to the invention, one of said opposite ends of said curved pipe is fastened to said connecting lower end, while said connector is mounted at the other of said opposite ends, and said connector is driven toward said connecting upper end in a direction oriented from said head toward said foot, guiding said curved pipe through said frame.

Other features and advantages of the invention will emerge on reading the following description of one particular embodiment of the invention given by way of nonlimiting illustration with reference to the appended drawings, in which.

Figure 1:
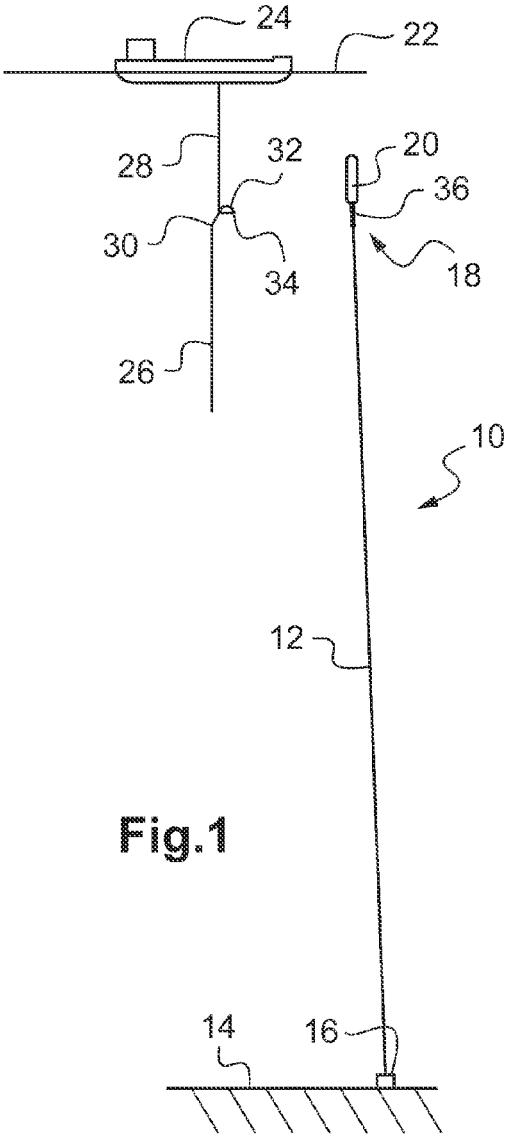
FIG. 1 is a diagrammatic view showing an underwater connection method according to the invention.

FIG. 1 shows diagrammatically a tower 10 including a rigid riser pipe 12 fixed to a seabed 14 by means of an anchor system 16. Moreover, the rigid pipe 12 includes an upper part 18, suspended from a float 20, in which is trapped a sufficient quantity of air to maintain the rigid pipe in a vertical position. The float 20 is situated in an area between the seabed 14 and a surface 22, and to be more precise toward the surface 22. This area is nevertheless chosen at a distance from the surface 22 so as to be less dependent on surface movements.

FIG. 1 also shows a laying ship 24 sailing on the surface 22 in line with the tower 10. A flexible pipe 26 is suspended from the laying ship 24 by means of a cable 28. The flexible pipe 26 includes a lower end 30 extended by a curved pipe 32 terminated by a connector 34. The elements fastened to the flexible pipe 26 are described in more detail hereinafter. The latter are supported by the laying ship 24 in the vicinity of the upper part 18 of the rigid pipe 12 in order to be connected thereto as explained hereinafter. To this end, the upper part 18 of the rigid pipe 12 includes longitudinal frame 36 described first with reference to the FIG. 2 front view of it.

Figure 2:
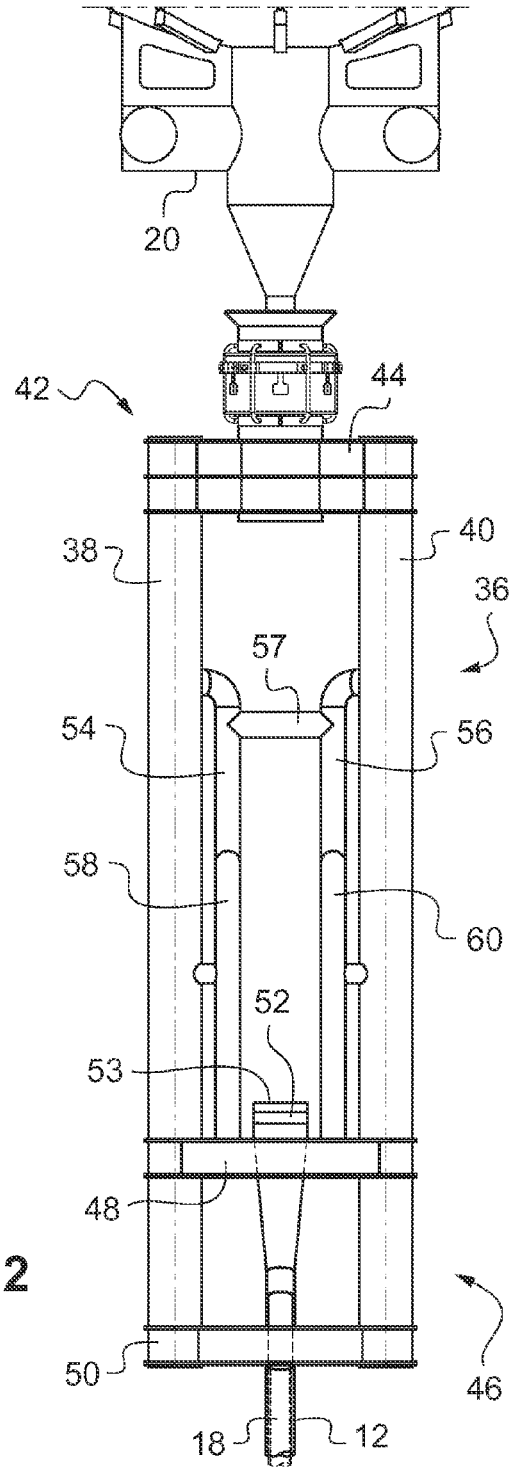
FIG. 2 is a diagrammatic front elevation view of one of the elements of an underwater connection assembly according to the invention.

This FIG. 2 shows the frame 36. They include two parallel cylindrical main uprights 38, 40 between 10 and 15 m long, for example. The main uprights 38, 40 are connected together in an upper end 42 of the frame 36 forming a head by an upper crossmember 44 connected to the float 20 and in a lower end 46 forming a foot by two superposed lower crossmembers 48, 50. A first lower crossmember 50 is at the lower extremum of the frame 36 while a second crossmember 48 is spaced from the first toward the upper end 42 of the frame 36. This figure also shows the upper part 18 of the rigid riser pipe which ends in a connecting upper end 52 held across the lower crossmembers 48, 50 between the main uprights 38, 40, substantially equidistantly therefrom. It will be noted that the connecting upper end 52 has a male end fitting 53 projecting from the second crossmember 48 toward the upper end 42. Thus the frame 36 notably makes it possible to connect the float 20 and the riser pipe 12 together in such a manner as to maintain the latter vertical in the water.

Moreover, FIG. 2 shows guide ramps comprising two posterior uprights 54, 56 extending from the second crossmember toward the upper crossmember 44 a distance substantially corresponding to two-thirds of that between the second crossmember 48 and the upper crossmember 44. The two posterior uprights 54, 56 extend along the main uprights 38, 40, respectively, substantially to the rear of the connecting upper end 52. And they are connected together in their upper part by a spacer 57. The guide ramps also comprise two anterior uprights 58, 60 respectively parallel to and facing the posterior uprights 54, 56. The two anterior uprights 58, 60 extend substantially in front of the connecting upper end 52 a distance substantially corresponding to half the distance between the second crossmember 48 and the upper crossmember 44. The two pairs of anterior and posterior uprights 54, 58; 56, 60 therefore constitute two parallel guide spaces 59 on respective opposite sides of the connecting upper end 52. These two guide spaces 59 extend from the lower end 46 forming a foot toward the upper end 42 forming a head. They further define a middle plane axially intersecting the male end fitting 53 of the connecting upper end 52.

Figure 3:
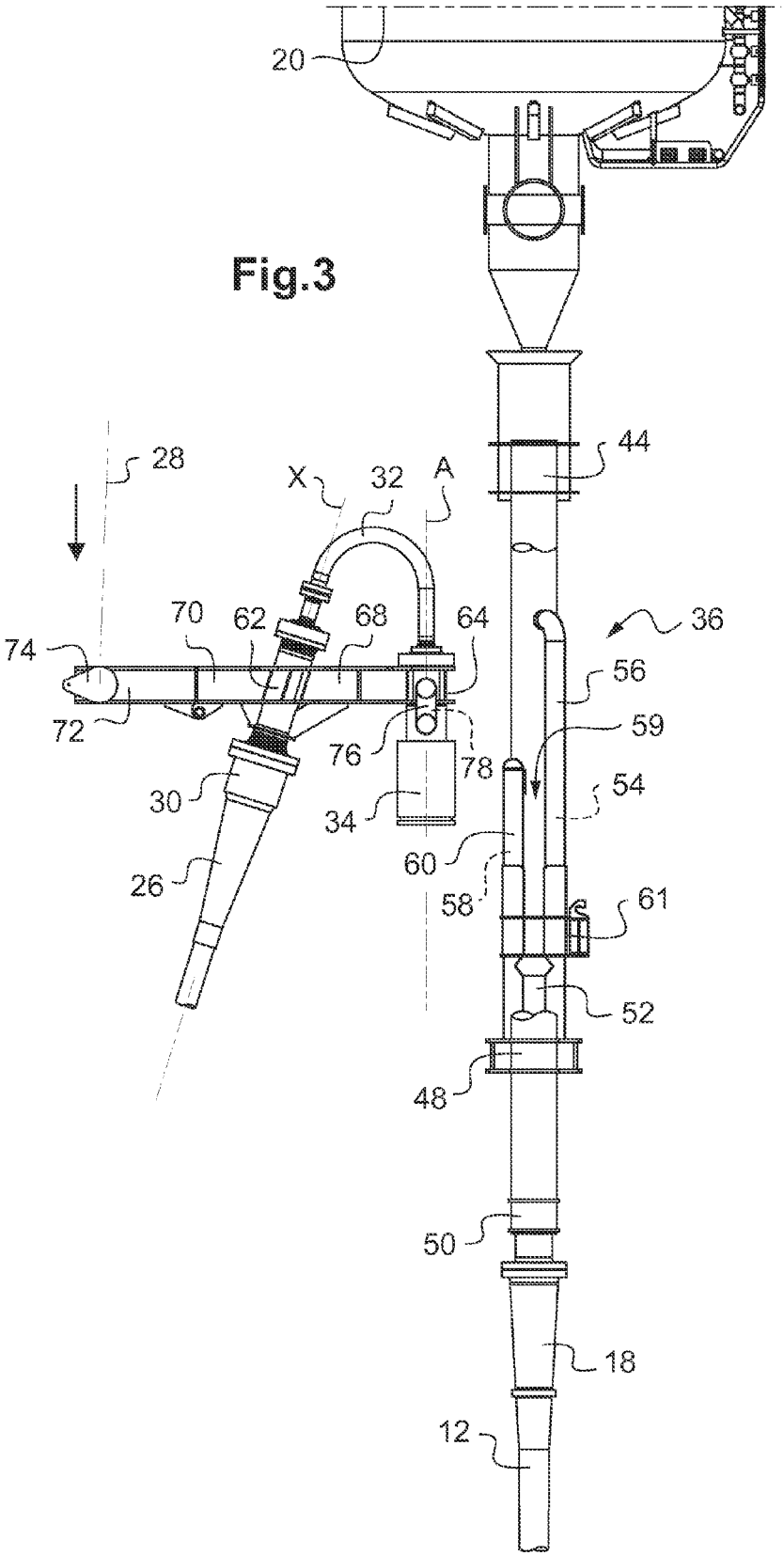
FIG. 3 is a diagrammatic side elevation view showing said one of the elements shown in FIG. 2 and another element of the connection assembly.

Refer now to FIG. 3, which shows from the side the frame 36 as shown in FIG. 2 and partly shows the equipped lower end 30 of the flexible pipe retained by the cable 28. Thus at the level of the chassis 36 are seen the posterior uprights 54, 56 and the anterior uprights 60, 58, which extend from the second crossmember 48. There is also shown therein the connecting upper end 52. Moreover, the frame 36 includes a receiving carriage 61 installed in the vicinity of the connecting upper end 52 and including four sleeves respectively mounted to slide on the posterior uprights 54, 56 and the anterior uprights 60, 58. The role of the receiving carriage 61 is explained hereinafter.

With regard to the lower end 30 of the flexible tubular pipe 26, it is connected to a first end 62 of the curved pipe 32, which extends in a substantially inverted U-shape as far as a second end 64. This second end 64 terminates in the connector 34. It will be noted that the latter includes a female end-fitting. The first end 62 and the second end 64 are connected together by means of a connecting beam 68 which is extended by a cantilever arm 70 opposite the second end 64 relative to the first end 62 of the curved pipe 32. In accordance with the embodiment shown in FIG. 3, the cantilever arm 70 includes a removable part 72 terminating in an anchoring free end 74. The cable 28 is then attached to this anchoring end 74.

With regard to the second end 64 of the curved pipe 32, it includes oblong lateral guide studs 76, 78 that extend in an axial direction A of the connector 34 and project from the second end 64. To be more precise, the two oblong lateral guide studs 76, 78 define a middle plane axially intersecting the connector 34. Moreover, the oblong lateral guide studs 76, 78 respectively include two parallel and substantially plane opposite bearing surfaces parallel to the axial direction A of the connector 34.

It will be noted that the axial direction X of the first end 62 of the curved pipe 32 is inclined relative to the axial direction A of the connector 34. As a result, the flexible pipe 26, which is equipped with a stiffener sleeve that extends from the lower end 30 beyond the cantilever arm 70, exerts a weighting force substantially on the axis of the cable 28, which makes it possible for the connecting beam 68 and the arm 70 that extends it to remain substantially horizontal. Moreover, thanks to the horizontal distance between the anchoring end 74 and the second end 64 of the curved pipe 32, the connector 34 can be carried transversely through the frame 36 by means of the cable 28 without the float 20 being able to impede this.

Figure 4:
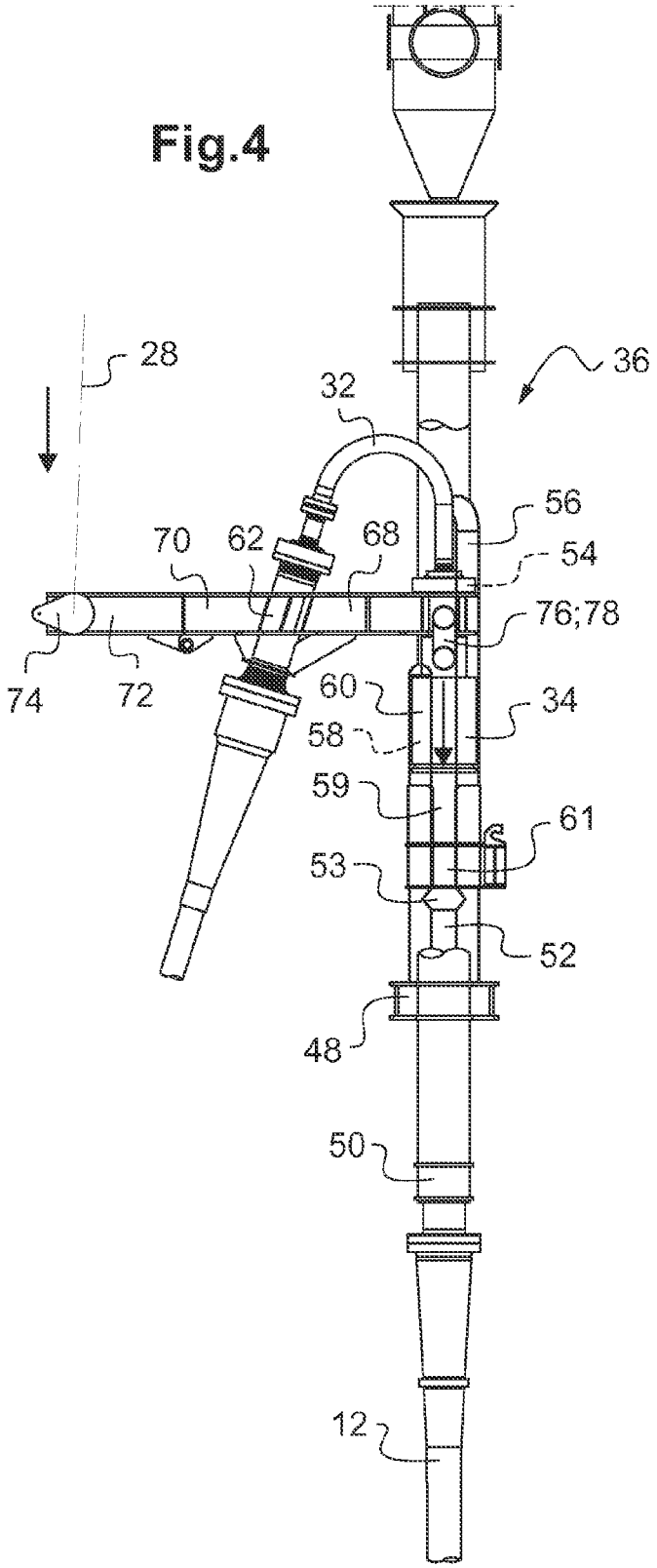
FIG. 4 is a diagrammatic view in side elevation showing how said other element cooperates with said one of the elements during a first connection phase.

As shown in FIG. 4, thanks to the laying vessel 24, the cable 28 therefore holds the flexible pipe 26 hanging down via the cantilever arm 70 and the first end 62 of the curved pipe 32 and has been drawn toward the frame 36 until the guide studs 76, 78 have come to bear laterally against the posterior uprights 54, 56 above the shorter anterior uprights 58, 60. The connector 34 is then located between the posterior uprights 54, 56 and the anterior uprights 60, 58. And it is then coaxial with the connecting upper end 52 and to be more precise the connecting end fitting 53 of the rigid riser pipe 12.

Starting from this relative position of the curved pipe 32 and the frame 36, the cable 28 is progressively released so as to lower the arm 70 and the connecting beam 68 relative to the frame 36 and thus to allow the guide studs 76, 78 to engage behind the anterior uprights 60, 58, respectively, inside the aforementioned guide spaces 59. The thickness of the oblong guide studs 76, 78 is substantially equal to the distance between the posterior uprights 54, 56 and the anterior uprights 58, 60, respectively, ignoring the functional clearance. As a result, the oblong guide studs 76, 78 slide freely inside the guide spaces 59 as the cable 28 is released.

Thanks to their plane opposite bearing surfaces respectively guided by the posterior uprights 54, 56 and the anterior uprights 58, 60, the oblong guide studs 76, 78 make it possible to hold the connector on the axis of the connecting upper end 52 during the phase of moving the connector 34 and the connecting end fitting 53 toward each other until the connector caps the connecting end fitting 53. The connection is then made automatically in a manner known in itself, for example by means of conical connecting members and spring-loaded locking jaws. The rigid riser pipe 12 and the flexible pipe 26 are then connected continuously and in a sealed manner via the curved pipe 32.

Figure 6:
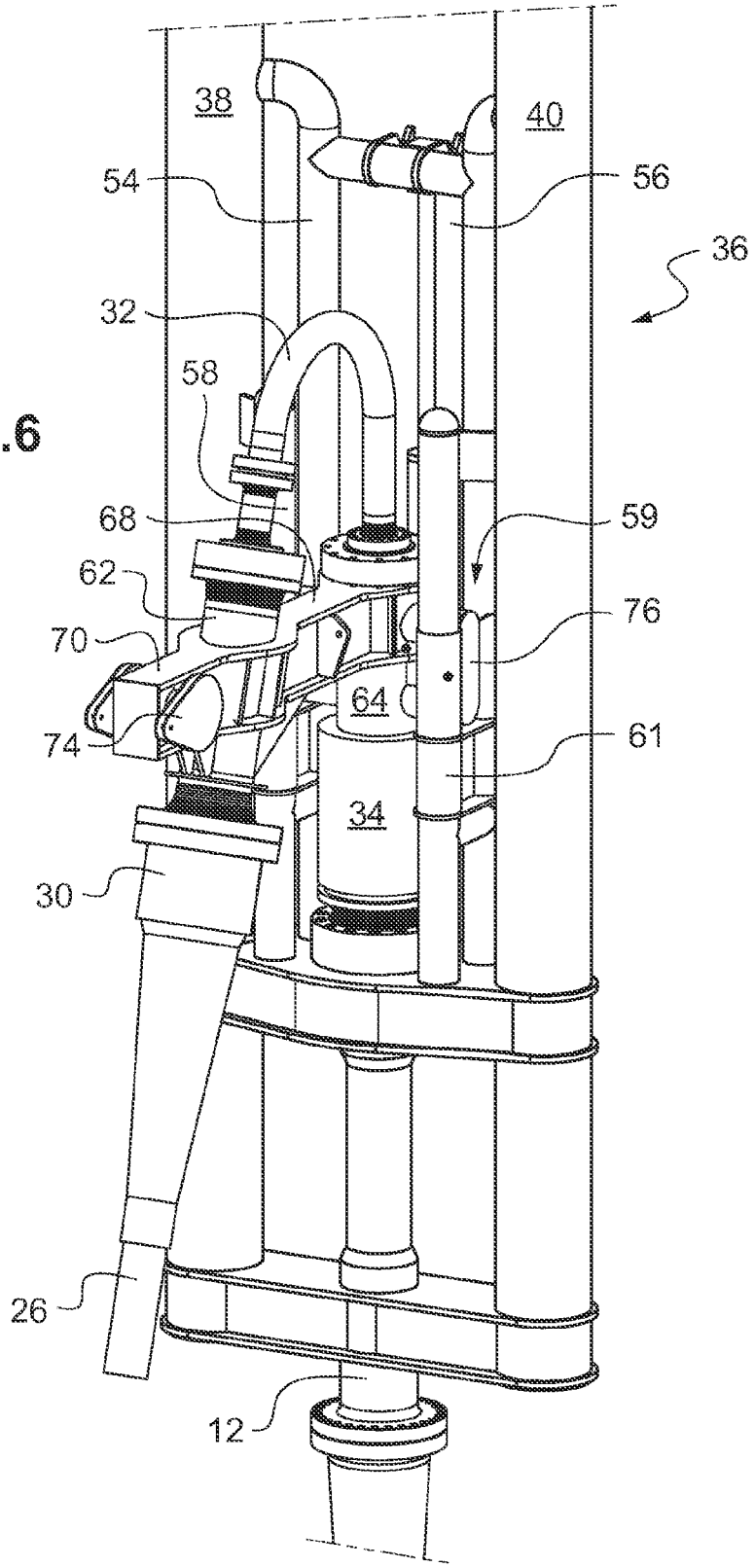
FIG. 6 is a diagrammatic three-quarter front perspective view of the elements shown in FIG. 5.

The oblong guide studs 76, 78 then bear on the receiving carriage 61. FIG. 6 shows the flexible pipe 26 and the rigid riser pipe 12 connected together in this way at the level of the frame 36. This FIG. 6 shows a cantilever arm 70 with no removable part. The connector 34 caps the male connecting end fitting that it conceals in FIG. 6 and the oblong guide studs 76, 78 respectively engaged between the posterior uprights 54, 56 and the anterior uprights 58, 60 enable perfect anchoring of the flexible pipe 26 by means of the second end 64 of the curved pipe 32, the connecting beam 68 and the first end 62 of the curved pipe 32, to which is directly connected the connecting lower end 30 of the flexible pipe 26.

Figure 5:
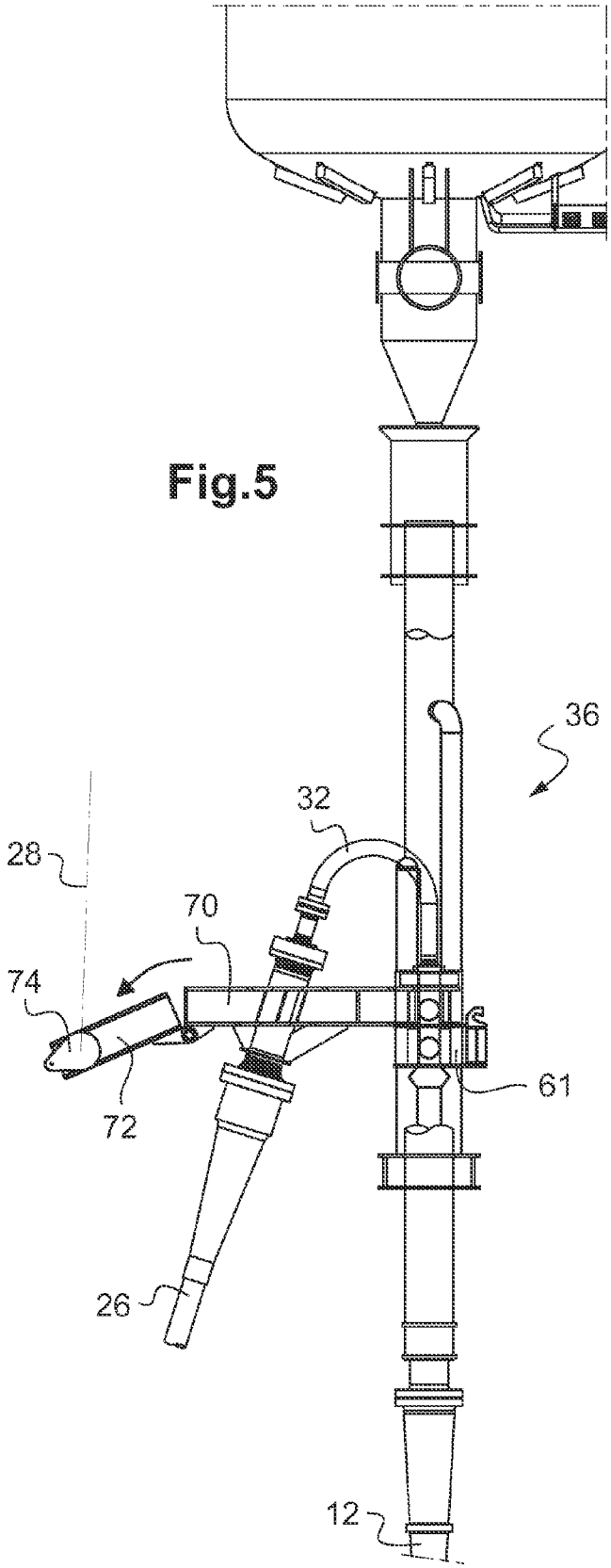
FIG. 5 is a diagrammatic side elevation view of the elements shown in FIG. 4 during a second connection phase.

FIG. 5 shows again all the elements shown in FIG. 4, in the connection situation as described with reference to FIG. 6. The removable part 72 of the cantilever arm 70 is being demounted by means of an underwater robot which is not shown. It could then be raised to the surface and onto the laying ship by means of the cable 28.

The other end of the flexible pipe 26, which cannot be seen in FIG. 6, and which extends toward the seabed, is then raised to the surface by means of another cable which is not shown. Thus the rigid riser pipe 12 and the flexible pipe 26 connect the seabed and the surface and can convey a fluid hydrocarbon from the seabed to the surface.

Figure 7:
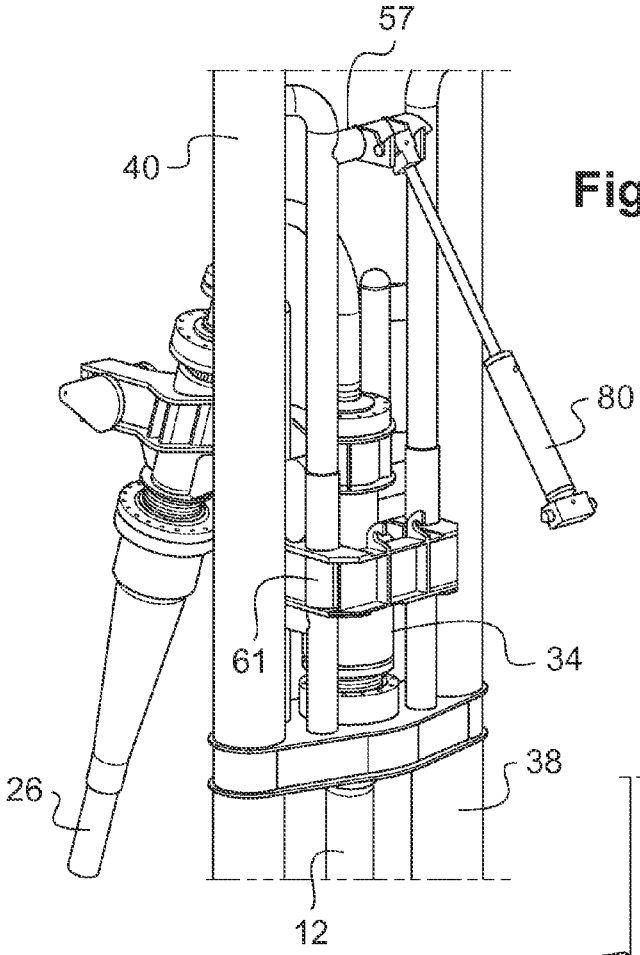
FIG. 7 is a diagrammatic three-quarter rear perspective view of the elements shown in FIG. 6 during a third connection phase.

Refer now to FIG. 7, showing a step of partial demounting of the connecting assembly according to the invention for a maintenance phase.

Figure 8:
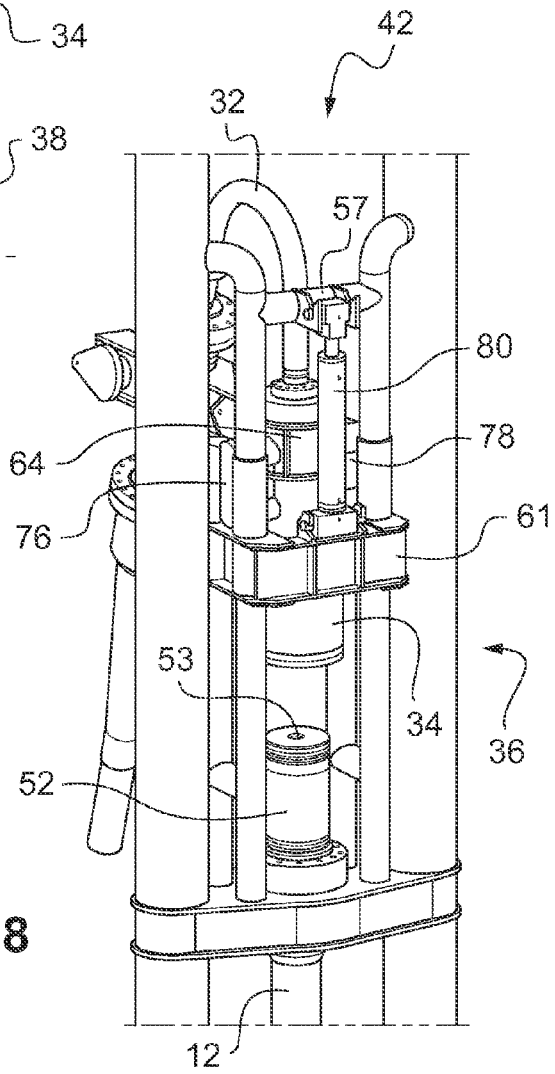
FIG. 8 is a diagrammatic perspective view of the elements shown in FIG. 7 during a fourth connection phase.

It is therefore a question of disconnecting the rigid riser pipe 12 and the flexible pipe 26. To this end a traction device, to be more precise a hydraulic cylinder 80 here, is installed by means of an underwater robot that is not shown. This is mounted when extended between the spacer 57 and the receiving carriage 61. As soon as disconnection is required, as shown in FIG. 8, the hydraulic cylinder 80 is therefore caused to retract, which makes it possible to drive in translation the receiving carriage 61 on which the oblong lateral guide studs 76, 78 bear. Because of this, the second end 64 of the curved pipe 32 is driven in translation toward the upper end 42 of the frame 36 and likewise the connector 34 is disconnected from the male end fitting 53 of the connecting upper end 52.

A plug, not shown, is then installed in the connector 34 by means of the underwater robot in order to prevent return flow of the hydrocarbon. Maintenance operations can therefore be carried out on the riser pipe 12.

The invention claimed is:

1. An underwater connection assembly for connecting, between a seabed and a sea surface, said assembly comprising a riser pipe extending from said seabed toward said sea surface, and a flexible pipe extending to said sea surface, said riser pipe having a connecting upper end and said flexible pipe having a connecting lower end;

a longitudinal frame including a foot fastened to said connecting upper end and a head configured to be connected to a float; a connector; and a curved pipe having two opposite ends, said curved pipe being configured to connect said flexible pipe in a catenary manner to said riser pipe with the connector;

wherein said frame comprises opposing guide ramps extending in a direction oriented from said head toward said foot, one of said opposite ends of said curved pipe is configured to be fastened to said connecting lower end of said flexible pipe while said connector is mounted at the other of said opposite ends of said curved pipe, wherein said connector is configured to be received between the opposing guide ramps to guide said curved pipe through said frame to drive said connector toward said connecting upper end in said direction oriented from said head toward said foot.

2. The underwater connection assembly as claimed in claim 1, wherein said other of said opposite ends of said curved pipe comprises diametrically opposite guide studs configured to cooperate with said guide ramps.

3. The underwater connection assembly as claimed in claim 2, wherein said guide ramps comprise two posterior uprights respectively adapted to receive said guide studs that bear on said guide ramps.

4. The underwater connection assembly as claimed in claim 3, wherein said guide ramps further comprise two anterior uprights respectively facing said posterior uprights to be configured to trap said guide studs.

5. The underwater connection assembly as claimed in claim 2, wherein said guide studs include longitudinal bearing surfaces extending parallel to an axis of said connector.

6. The underwater connection assembly as claimed in claim 1, wherein said frame further comprises a receiving carriage mounted to slide on said guide ramps to receive said other of said opposite ends of said curved pipe that bears on said receiving carriage.

7. The underwater connection assembly as claimed in claim 1, wherein said two opposite ends of said curved pipe define two axial directions substantially inclined one relative to the other.

8. The underwater connection assembly as claimed in claim 1, wherein said curved pipe comprises a connecting beam configured for connecting together said two opposite ends.

9. The underwater connection assembly as claimed in claim 8, wherein said connecting beam includes an arm extending cantilever fashion in line with said connecting beam opposite said other of said opposite ends relative to said one of said opposite ends.

10. The underwater connection assembly as claimed in claim 9, wherein said arm includes a removable part.

11. A method of underwater connection, between a seabed and a sea surface, of a riser pipe extending from said seabed toward said sea surface and a flexible pipe extending to said surface, said riser pipe including connecting upper end and said flexible pipe including a connecting lower end;

said connection method comprising providing a longitudinal frame having a foot fastened to said connecting upper end and a head configured to be connected to a float; a connector; and a curved pipe having two opposite ends and configured to connect said flexible pipe in catenary manner to said riser pipe with the connector;

fastening one of said opposite ends of said curved pipe to said connecting lower end;

mounting said connector at the other of said opposite ends, locating said connector between opposing guide ramps in said longitudinal frame; and driving said connector toward said connecting upper end in a direction oriented from said head toward said foot, to guide said curved pipe through said frame.

* * * * *